US010641230B2

(12) United States Patent
Wakasugi et al.

(10) Patent No.: US 10,641,230 B2
(45) Date of Patent: May 5, 2020

(54) IGNITION APPARATUS OF INTERNAL COMBUSTION ENGINE

(71) Applicant: DENSO CORPORATION, Kariya, Aichi-pref. (JP)

(72) Inventors: Ryota Wakasugi, Nisshin (JP); Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/244,382

(22) Filed: Jan. 10, 2019

(65) Prior Publication Data

US 2019/0211793 A1 Jul. 11, 2019

(30) Foreign Application Priority Data

Jan. 11, 2018 (JP) ..... 2018-002931

(51) Int. Cl.
*F02P 3/01* (2006.01)
*F02P 9/00* (2006.01)
*F02P 3/04* (2006.01)

(52) U.S. Cl.
CPC ..... *F02P 3/01* (2013.01); *F02P 3/0407* (2013.01); *F02P 9/002* (2013.01); *F02P 9/007* (2013.01)

(58) Field of Classification Search
CPC .. F02P 3/01; F02P 9/002; F02P 3/0407; F02P 9/007; F02P 23/045
See application file for complete search history.

(56) References Cited

U.S. PATENT DOCUMENTS 4,487,177 A * 12/1984 Ishikawa ..... H01T 13/467 123/143 B
5,568,801 A * 10/1996 Paterson ..... F02P 9/007 123/143 B
6,020,742 A * 2/2000 Kano ..... F02P 17/12 324/378
6,357,426 B1 * 3/2002 Schleupen ..... F02P 3/01 123/606
9,534,575 B2 * 1/2017 Eberhardt ..... F02P 19/02
9,903,335 B2 * 2/2018 Kinoshita ..... F02P 9/002
9,957,946 B2 * 5/2018 Kinoshita ..... F02P 3/053
(Continued)

FOREIGN PATENT DOCUMENTS

JP 2524699 8/1996

*Primary Examiner* — Sizo B Vilakazi
*Assistant Examiner* — Brian R Kirby
(74) *Attorney, Agent, or Firm* — Nixon & Vanderhye P.C.

(57) ABSTRACT

An ignition apparatus of an internal combustion engine is provided with an ignition plug, an AC (alternating current) voltage application unit configured to apply AC voltage to the center electrode of the ignition plug, and an application voltage control unit that controls an operation of the AC voltage application unit. The application voltage control unit is configured to control the AC voltage application unit to apply the center electrode with a first AC voltage having an amplitude smaller than that of a required voltage of the ignition plug in a first period which is before an ignition timing, and to apply the center electrode with a second AC voltage having an amplitude smaller than that of the first AC voltage or to stop applying the center electrode with the AC voltage during a second period which is before the ignition timing after the first period has elapsed.

9 Claims, 10 Drawing Sheets

(56) References Cited

U.S. PATENT DOCUMENTS

| | | | | |
|---|---|---|---|---|
| 2012/0180742 | A1* | 7/2012 | Burrows | F02P 9/007<br>123/143 B |
| 2013/0160752 | A1* | 6/2013 | Kim | F02P 13/00<br>123/636 |
| 2013/0208393 | A1* | 8/2013 | Hampton | F02P 9/002<br>361/247 |
| 2014/0174416 | A1* | 6/2014 | Okabe | H01T 13/52<br>123/608 |
| 2015/0008838 | A1* | 1/2015 | Reuther | F02P 3/0442<br>315/209 T |
| 2015/0144115 | A1* | 5/2015 | Kosuge | H01T 13/08<br>123/608 |
| 2017/0096979 | A1* | 4/2017 | Kinoshita | F02P 9/002 |
| 2017/0276114 | A1* | 9/2017 | Kinoshita | F02P 3/053 |
| 2019/0120144 | A1* | 4/2019 | Cook | H01T 2/02 |

* cited by examiner

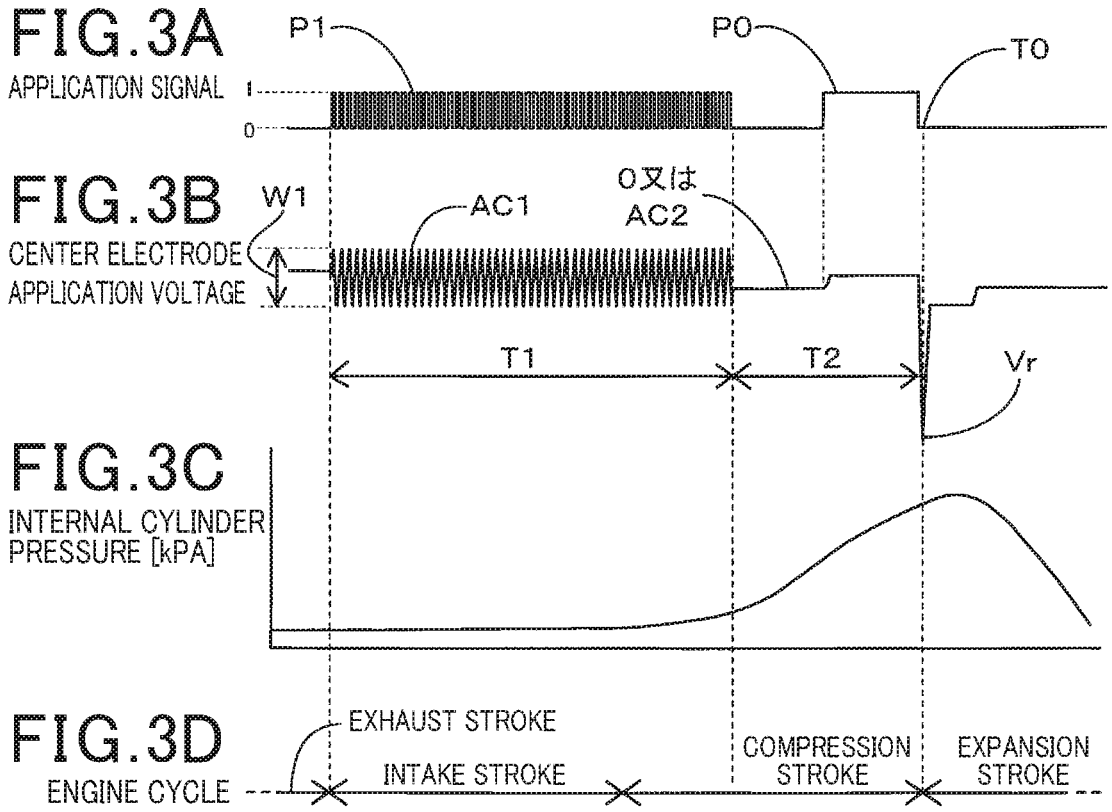
FIG.3A
APPLICATION SIGNAL
P1
P0
T0
1
0
FIG.3B
CENTER ELECTRODE
APPLICATION VOLTAGE
W1
AC1
0又は
AC2
T1
T2
Vr
FIG.3C
INTERNAL CYLINDER
PRESSURE [kPA]
FIG.3D
ENGINE CYCLE
EXHAUST STROKE
INTAKE STROKE
COMPRESSION
STROKE
EXPANSION
STROKE
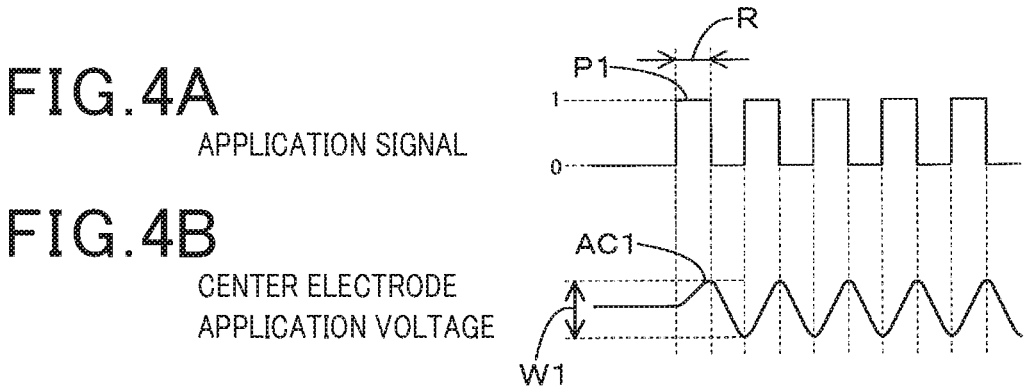
FIG.4A
APPLICATION SIGNAL
FIG.4B
CENTER ELECTRODE
APPLICATION VOLTAGE
R
P1
1
0
AC1
W1

◎ REQUIRED VOLTAGE REDUCTION EFFECT IS LARGER THAN OR EQUAL TO 20%

○ REQUIRED VOLTAGE REDUCTION EFFECT IS LARGER THAN OR EQUAL TO 5% AND LESS THAN 20%

× REQUIRED VOLTAGE REDUCTION EFFECT IS LESS THAN 5% OR DISCHARGE SPARK IS FORMED

◎ REQUIRED VOLTAGE REDUCTION EFFECT IS LARGER THAN OR EQUAL TO 20%

○ REQUIRED VOLTAGE REDUCTION EFFECT IS LARGER THAN OR EQUAL TO 5% AND LESS THAN 20%

× REQUIRED VOLTAGE REDUCTION EFFECT IS LESS THAN 5% OR DISCHARGE SPARK IS FORMED

IGNITION APPARATUS OF INTERNAL COMBUSTION ENGINE

CROSS-REFERENCE TO RELATED APPLICATION

This application is based on and claims the benefit of priority from earlier Japanese Patent Application No. 2018-2931 filed Jan. 11, 2018, the description of which is incorporated herein by reference.

BACKGROUND

Technical Field

The present disclosure relates to an ignition apparatus of an internal combustion engine.

Description of the Related Art

Recently, in order to improve the fuel efficiency of a vehicle, downsizing of the internal combustion engine has advanced using high compression ratio techniques or a supercharger. Accordingly, the internal cylinder pressure at a time of ignition and required voltage of an ignition plug tend to increase. When the required voltage exceeds the limit voltage of the ignition plug, spark discharge is likely to occur in a portion other than the discharge gap, which is referred to as so-called deep flying-discharge and may cause degradation of ignitability or damage of the ignition apparatus. In this respect, Japanese Patent Number 2524699 discloses a configuration in which a high voltage signal having high frequency is applied to the ignition plug to generate ions around the discharge gap and increase the temperature of the electrode immediately before the ignition, thereby lowering the required voltage. Thus, the required voltage is prevented from exceeding the limit voltage so as to avoid degradation of the ignitability and damage of the ignition apparatus.

However, according to the configuration disclosed by the above-described patent literature, a high frequency application apparatus including a piezoelectric device and a transformer is required in order to apply a high voltage signal having high frequency to the ignition apparatus. Hence, the ignition apparatus increases in size and high cost is required. Further, since high voltage is required immediately before the ignition, flashover or corona discharge may be produced before the major discharge and thus cause lower ignitability.

SUMMARY

The present disclosure has been achieved in light of the above-described circumstances and provides an ignition apparatus for an internal combustion engine in which an ignitability is improved and an increase in size and high cost are avoided.

As a first aspect of the present disclosure, an ignition apparatus of an internal combustion engine is provided with an ignition plug, an AC (alternating current) voltage application unit configured to apply AC voltage to the center electrode of the ignition plug, and an application voltage control unit that controls an operation of the AC voltage application unit. The ignition plug includes an insulator having a cylindrical shape, a center electrode having a rod-shape, being supported in the insulator to be coaxial therewith, in which a tip end of the center electrode is exposed therefrom, a housing that supports the insulator, a ground electrode connected to the housing, forming a discharge gap between the tip end of the center electrode and the ground electrode, and a pocket constituted of a space formed between an outer periphery surface of a tip end of the insulator and an inner periphery surface of the housing, in which a portion in a tip end side of the pocket is opened. The application voltage control unit is configured to control the AC voltage application unit to apply the center electrode with a first AC voltage having an amplitude which is smaller than that of a required voltage of the ignition plug in a first period which is before an ignition timing, and to apply to the center electrode a second AC voltage having an amplitude smaller than that of the first AC voltage or to stop applying the center electrode with the AC voltage during a second period which is before the ignition timing after the first period has elapsed.

In the ignition apparatus of the above-described internal combustion engine, the first AC voltage having smaller amplitude than the required voltage can be applied during the first period before the ignition timing. Thus, an AC electric field is produced in the pocket and the discharge gap of the ignition plug, whereby the gas molecules in the pocket and the discharge gap can be ionized or activated. Then, during the second period which is before the ignition timing after the first period has elapsed, the second AC voltage having smaller amplitude than the first AC voltage is applied to the center electrode, or application of the AC voltage to the center electrode is stopped. Hence, ionized or activated gaseous molecules which are generated in the pocket and the discharge gap are diffused and emitted from the pocket and the discharge gap. Then, a part of the ionized or activated gaseous molecules reach the discharge gap when the ignition plug is ignited, or ultraviolet light, emitted when a part of the activated gaseous molecules return to the ground level, reaches the discharge gap G when the ignition plug is ignited. Thus, initial electron supply at the discharge gap is accelerated to lower the required voltage. Hence, occurrence of major discharge in the discharge gap can be accelerated. As a result, discharge can be reliably formed in the gap portion and deep flying-discharge can be avoided so that ignitability can be improved. Further, since the AC voltage applied to the ignition plug is low, and the application of the AC voltage is stopped during the second period immediately before the ignition, a flashover or a corona discharge can be avoided before the major discharge occurs. Moreover, since high voltage-high frequency signal is not necessarily applied to the ignition apparatus, the apparatus can be prevented from becoming larger, and the manufacturing cost thereof can be suppressed.

As described, according to the present disclosure, an ignition apparatus is provided in which ignitability is improved and an increase in size and high cost are avoided.

Note that, the reference numerals in parentheses described in the claims and the means for solving the problems indicate the corresponding relationship between the specific means described in the following embodiments, and do not limit the technical range of the present invention.

BRIEF DESCRIPTION OF THE DRAWINGS

In the accompanying drawings:

FIGS. 3A to 3D are timing diagrams showing a state of control according to a first embodiment;

FIGS. 4A and 4B are another set of timing diagrams showing a state of control according to the first embodiment;

DETAILED DESCRIPTION OF THE PREFERRED EMBODIMENTS

First Embodiment

Figure 1:
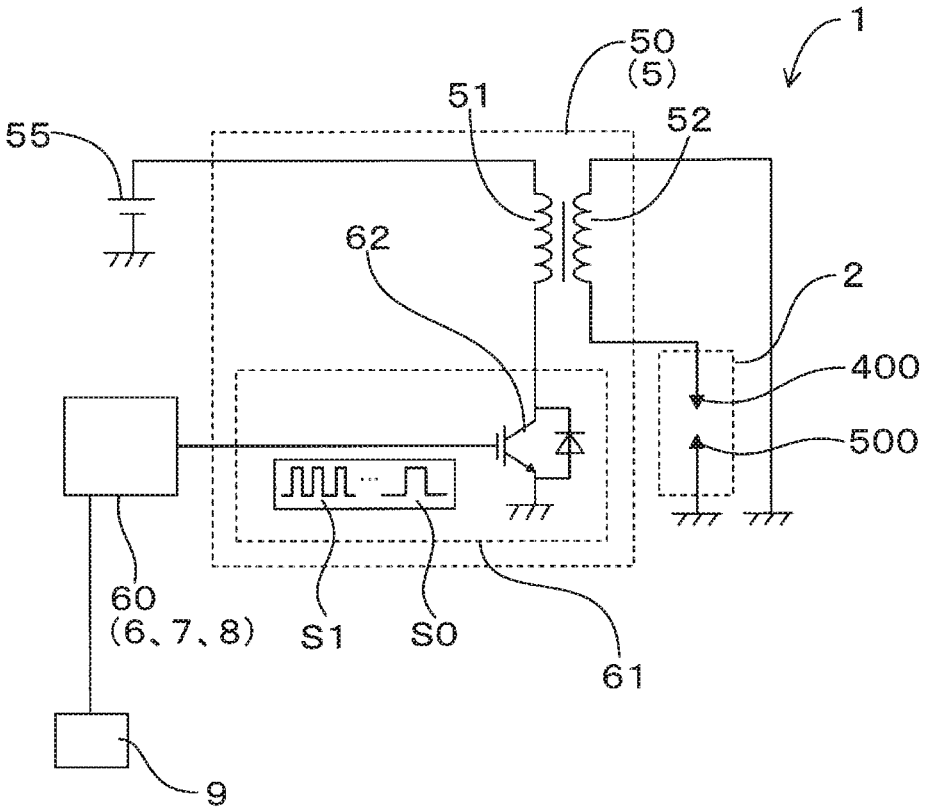
FIG. 1 is a schematic diagram showing a circuit configuration of an ignition apparatus according to a first embodiment of the present disclosure.
Figure 2:
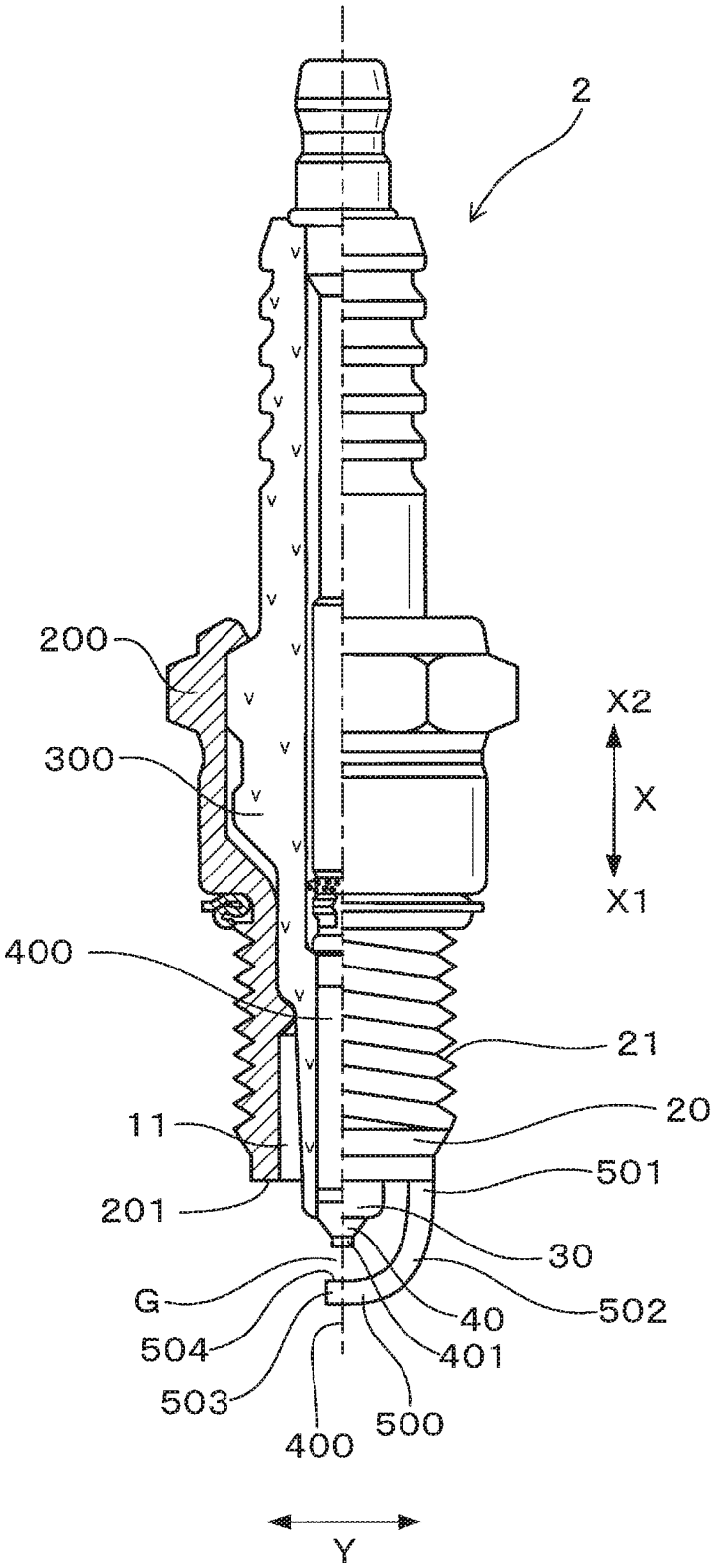
FIG. 2 is a partial cross-sectional view of an ignition plug when viewed from front side.

An embodiment of an ignition apparatus of an internal combustion engine will be described with reference to FIGS. 1 to 11. As shown in FIG. 1, the ignition apparatus 1 of the internal combustion engine according to the present embodiment includes an ignition plug 2, an AC (alternating current) voltage application unit 5, and an application voltage control unit 6. As shown in FIG. 2, the ignition plug 2 includes an insulator 300, a center electrode 400, a housing 200, a ground electrode 500 and a pocket 11. The insulator 300 has a cylindrical shape. The center electrode 400 has a rod-shape, and is supported in the insulator 300 to be coaxial therewith. A tip end 40 of the center electrode 400 is exposed from the insulator 300. The housing 200 supports the insulator 300. The ground electrode 500 is connected to the housing 200 and forms a discharge gap G between the tip end 40 of the center electrode 400 and the ground electrode 500. The pocket 11 is constituted of a space formed between an outer periphery surface of a tip end 30 of the insulator 300 and an inner periphery surface of the housing 200, and a portion in the tip end side X1 is opened. The AC voltage application unit 5 is configured to apply AC voltage to the center electrode 400. The application voltage control unit 6 controls an operation of the AC voltage application unit 5. Specifically, as shown in FIG. 3, the application voltage control unit 6 controls the AC voltage application unit 5 to apply the center electrode 400 with a first AC voltage AC1 having an amplitude W1 which is smaller than that of the required voltage Vr of the ignition plug 2 in a first period T1 which is before the ignition timing T0. Moreover, during a second period T2 which is before the ignition timing T0 after the T1 has elapsed, the application voltage control unit 6 controls the AC voltage application unit 5 to apply to the center electrode 400 a second AC voltage AC2 having an amplitude smaller than that of the first AC voltage AC1, or to stop applying the center electrode 400 with the AC voltage.

Hereinafter, detailed configuration of the ignition apparatus 1 will be described. The ignition apparatus 1 of the present embodiment is used for an ignition means of an internal combustion engine (engine) included in a vehicle, a co-generation, and a pump for circulating gas, for example. As shown in FIG. 2, the ignition apparatus 1 includes an attaching screw part 21 in an outer periphery part of the housing 200. The ignition apparatus 1 is attached to a combustion chamber of the internal combustion engine such that the attaching screw part 21 is screwed with a screw hole (not shown) provided in the wall portion of the combustion chamber.

The insulator 300 is inserted through the housing 200 inside thereof. The insulator 300 is disposed such that the tip end 30 protrudes from the tip end 20 of the housing 200. The pocket 11 opened towards the tip end side X1 in the axial direction X is formed between the housing 200 and the insulator 300. The pocket 11 is formed entirely inside the tip end 20 of the housing 200. The pocket 11 is configured of substantially cylindrical space.

The center electrode 400 is supported inside the insulator 300. The center electrode 400 is arranged such that the tip end 40 protrudes from the tip end of the insulator 300. In the tip end 40 of the center electrode 400, a tip end protrusion 401 protruding towards a facing portion 503 of the ground electrode 500 is provided.

As shown in FIG. 2, the ground electrode 500 is joined to the tip end surface 201 of the housing 200. The ground electrode 500 is constituted of a joint portion 501, a coupling portion 502 and the facing portion 503. The joint portion 501 extends in the axial direction X from the tip end surface 201 of the housing 200. The facing portion 503 includes a facing surface 504 that faces the tip end 40 of the center electrode 400, and the discharge gap G is formed between the facing surface 504 and the center electrode 400. The coupling portion 502 couples smoothly the joint portion 501 joined to the tip end surface 201 of the housing 200 and the facing portion 503 that faces the tip end 40 of the center electrode 400 in the axial direction X.

As shown in FIG. 1, the ignition apparatus 1 of the present embodiment is provided with an ignition coil 50 including a primary coil 51 and a secondary coil 52. The ignition plug 2 is connected to the secondary coil 52 side of the ignition coil 50. The ignition coil 50 is configured to apply AC voltage to the center electrode 400 of the ignition electrode as an Ac voltage application unit 5. The ECU 60 as an application voltage control unit 6 is configured to control the ignition coil 50 as the AC voltage application unit 5. In other words, the application voltage control unit 6 is configure such that a predetermined application signal P1 is transmitted to a switching element 62 of an ignitor 61, thereby applying an AC voltage having a predetermined amplitude to the center electrode 400.

Figure 5A:
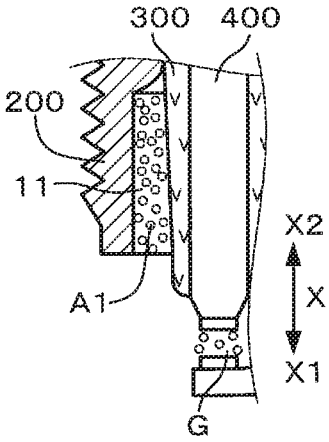
FIGS. 5A to 5E are conceptual diagrams showing ionization of gas molecules.
Figure 5B:
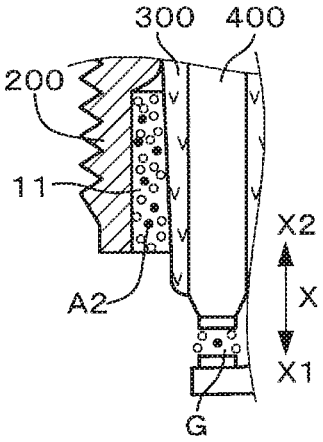
Figure 5C:
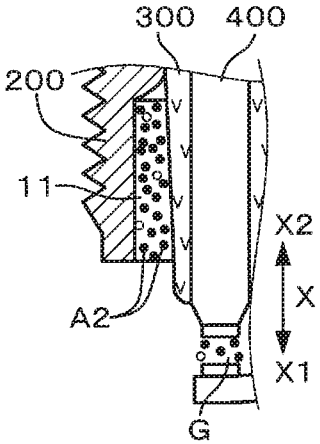

According to the present embodiment, as shown in FIG. 3A, during the first period T1, the ECU 60 as the application voltage control unit 6 outputs the application signal P1 to the ignitor 61 at a predetermined period. In response to this, as shown in FIG. 3B, the first AC voltage AC1 having a predetermined amplitude W1 is applied to the center electrode 400 from the ignitor 61 via the switching element 62. Thus, as shown in FIG. 5A, gaseous molecules A1 existing in the pocket 11 in a state where the first AC voltage AC1 is not yet applied, are ionized or activated in the pocket 11 as gaseous molecules A2 shown in FIGS. 5B and 5C. Similarly, gaseous molecules existing in the discharge gap G are also ionized or activated. In the first period T1, gaseous molecules A2 which have been ionized or activated in the pocket 11 and the discharge gap G stay in the pocket 11 and the discharge gap G as shown in FIG. 5C, because of AC electric field by the first AC voltage AC1 produced in the pocket 11 and the discharge gap G.

According to the present embodiment, the ECU 60 has a function of an internal cylinder pressure estimation unit 7 that estimates the internal cylinder pressure of the internal combustion engine based on a throttle opening quantity, an engine load, engine rotation speed, supercharger pressure and the like. The application voltage control unit 6 determines an amplitude W1 of the first AC voltage AC1 based on an estimated internal cylinder pressure estimated by the ECU 60 as the internal cylinder pressure estimation unit 7. For example, when the estimated internal cylinder pressure is higher than a predetermined reference value, the amplitude W1 can be a value higher than the predetermined amplitude W1, also when the estimated internal cylinder pressure is lower than the predetermined reference value, the amplitude W1 can be a value lower than the predetermined amplitude W1. As the predetermined reference value, it is not limited thereto. However, for example, the predetermined reference value may include the internal cylinder pressure when an intake valve (not shown) is opened (i.e. atmospheric pressure), or a map showing a correspondence between the throttle opening quantity, the engine load, the engine rotation speed and the like, and the internal cylinder pressure. As the predetermined reference amplitude, it is not limited thereto. However, an amplitude set in advance, or an amplitude of the application voltage immediately before applying can be employed.

The internal cylinder pressure estimation unit 7 calculates the estimated internal cylinder pressure at predetermined intervals Also, the application voltage control unit 6 compares the current internal cylinder pressure with a past estimated cylinder pressure or an average value of the past estimated cylinder pressure values. Then, the internal cylinder pressure estimation unit 7 controls the current amplitude W1 to be higher than the past amplitude W1 when the current estimated internal cylinder pressure is higher than the past values, and controls the current amplitude W1 to be lower than the past amplitude W1 when the current estimated internal cylinder pressure is lower than the past values.

As shown FIG. 4A, when the amplitude W1 is determined, the application voltage control unit 6 sets the ON period R which is a pulse width of the application signal P1 such that the first AC voltage AC1 applied to the center electrode 400 has the determined amplitude W1. The ON period R corresponds to a charge period of the ignition coil 50. Note that the duty ratio of the application signal P1 is defined as 50%. Even with the same frequency, the ON period R of the application signal P1 depends on the output voltage of the power source 55 shown in FIG. 1. When the output voltage of the power source 55 is low, the ON period R is set to be longer and when the output voltage of the power source 55 is high, the ON period R is set to be shorter.

Figure 11:
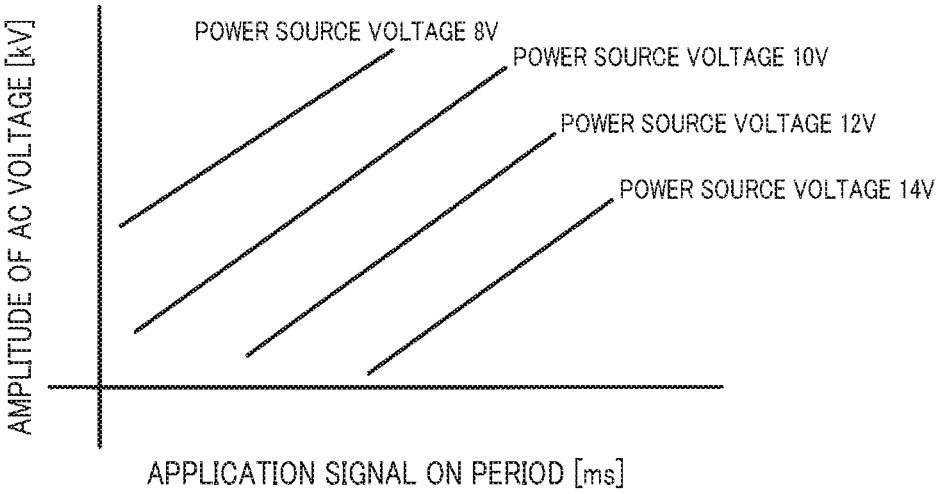
FIG. 11 is a conceptual diagram showing a map of a correlation between ON period of an application signal and an amplitude.

According to the present embodiment, the ECU 60 serves as a power source voltage detection unit 8 that detects the output voltage of the power source 55. A map showing a correspondence between the output voltage of the power source 55 and the amplitude W1 of first AC voltage AC1 is stored in a memory unit which is not shown. As shown in FIG. 11, a map is employed where a relationship between the ON period R of the application signal P1 and the amplitude of the first AC voltage AC1 is mapped for each output voltage of the power source 55. The application voltage control unit 6 is able to set the ON period R of the application signal P1 based on the output voltage of the power source 55 detected by the power source voltage detection unit 8.

According to the present embodiment, the first period T1 is defined in the engine cycle through the intake stroke to the compression stroke. According to the present embodiment, the intake stroke is defined as a period where the intake valve (not shown) of the internal combustion engine is opened, and the compression stroke is defined as a period until the major discharge is formed in a state where the intake valve is closed after completion of the intake stroke. The expansion stroke is defined as a period from when the major discharge is formed to when the exhaust valve (not shown) is opened. The exhaust stroke is defined as a period where the exhaust valve is opened after completion of the expansion stroke.

Figure 5D:
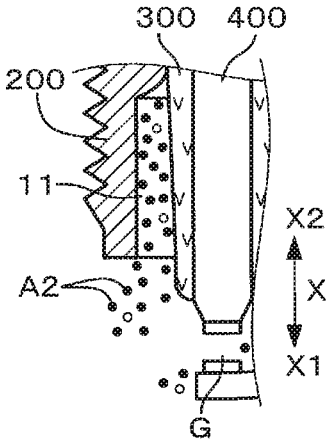
Figure 5E:
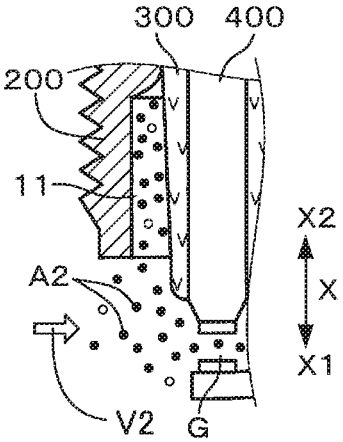

According to the present embodiment, as shown in FIG. 3C, the internal cylinder pressure is maintained at low during the first period T1. The application voltage control unit 6 stops applying the first AC voltage AC1 in the compression stroke or applies the second AC voltage AC2 of which the amplitude is lower than that of the first AC voltage AC1, to terminate the first period T1 and start the second period T2. In the second period T2, an AC electric field existing in the pocket 11 and the discharge gap G during the first period T1 disappears or is weakened, whereby ionized or activated gaseous molecules A2 remaining in the pocket 11 and the discharge gap G as shown in FIG. 5D are discharged from the pocket 11 and the discharge gap G towards the tip end side X1. Then, as shown in FIG. 5E, the discharged gaseous molecules which have been ionized or activated reach the discharge gap G by the gas flow V2 in the cylinder.

Duration of the second period T2 can be appropriately set. The duration of the second period T2 can be set as a period from the application stop timing of the first AC voltage AC1 to the ignition timing. Hence, by changing the application stop timing of the first AC voltage AC1, the duration of the second period T2 can be changed.

The duration of the second period T2 is preferably set considering a period where gaseous molecules A2 which have been ionized or activated in the pocket 11 and the discharge gap G reaches the discharge gap G, or a period where ultraviolet light, emitted when the activated gaseous molecules returns to the ground level, reaches the discharge gap G. For example, as shown in FIG. 6, the duration of the second period T2 is larger than or equal to a period where ionized gaseous molecules existing at the most closely to the discharge gap G in the opening 11*a* of the pocket 11 reach the discharge gap G, and smaller than or equal to a period where ionized gaseous mixture located in a deepest part 11*a* of the pocket 11 reach the discharge gap G from the position in the opening 11*a* of the pocket 11 which is farthest with respect the discharge gap G.

Figure 6:
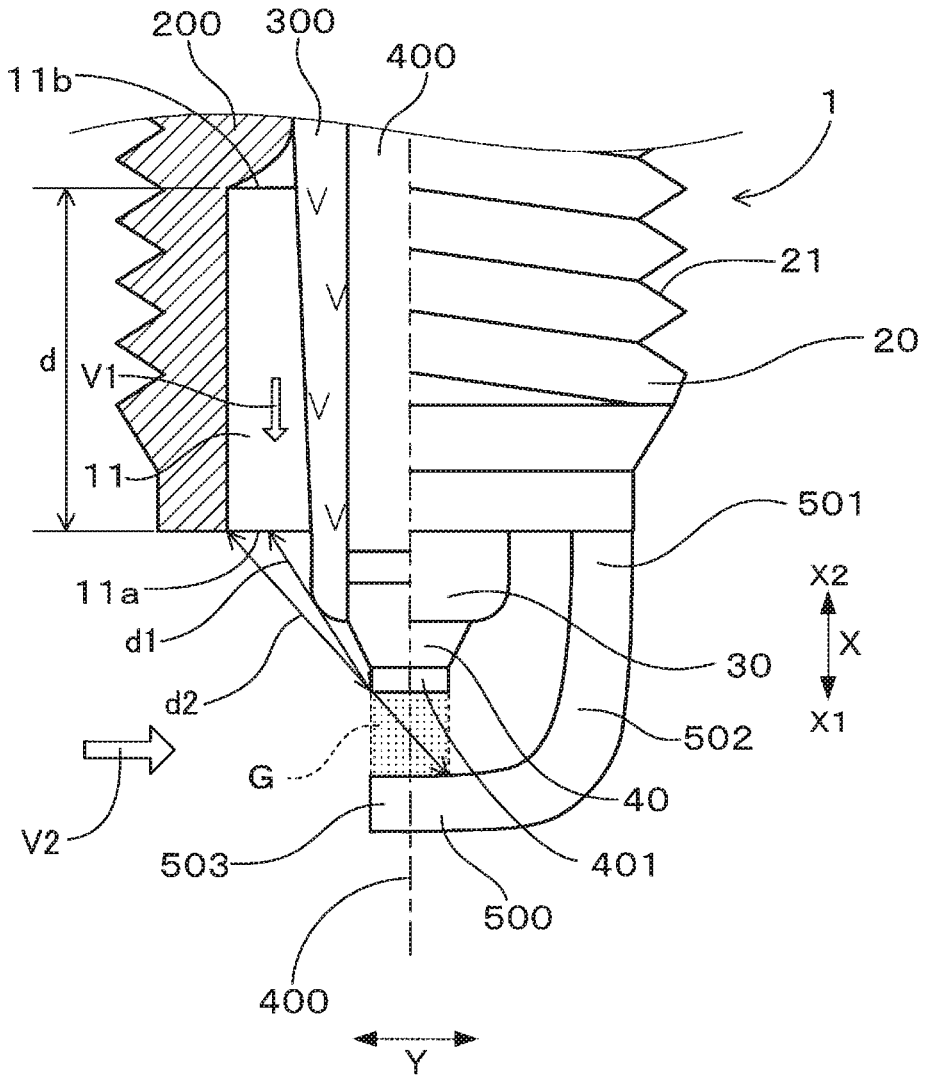
FIG. 6 is a partial enlarged view of FIG. 2.

In other words, as shown in FIG. 6, the duration t2 of the second period T2 preferably satisfies a relationship $d1/v2<t2<d/v1+d2/v2$, where a depth in the axial direction X of the pocket 11 is defined as d, the shortest linear distance between the discharge gap G and the opening 11*a* of the pocket 11 is defined as d1, the longest linear distance between the discharge gap G and the opening 11*a* of the pocket 11 is defined as d2, an ion diffusion rate in the pocket 11 is defined as v1, and a velocity of the gaseous mixture in the vicinity of the ignition plug 2 is defined as v2.

Further, the following relationship may preferably be satisfied.

1.5 mm≤d1≤7.2 mm and 4.0 mm≤d2≤7.4 mm, and d1≤d2, 4.0 mm≤d≤15.0 mm. According to the present embodiment, the above-dimensions are: d1=3.8 mm, d2=5.0 mm, d=10.3 mm, L=0.75 mm, v1=1.0 m/sec, and v2=10 m/sec. When applying the above values into an equation: d1/v2<t2<d/v1+d2/v2, 0.38 ms<t2<10.8 ms is obtained.

According to the present embodiment, as shown in FIG. 1, a rotation speed detection unit 9 that detects an engine rotation speed of the internal combustion engine is provided. Then, the application voltage control unit 6 is able to change the duration of the second period T2. For example, the duration of the second period T2 is set to be shorter when the engine rotation speed detected by the rotation speed detection unit 9 is larger than a predetermined reference value, and the duration of the second period T2 is set to be longer when the engine rotation speed detected by the rotation speed detection unit 9 is smaller than a predetermined reference value. Moreover, a correspondence between the engine rotation speed and the duration of the second period may be stored in advance in a memory unit which is not shown, and the second period T2 may be changed based on the detected engine rotation speed and the map.

Figure 7:
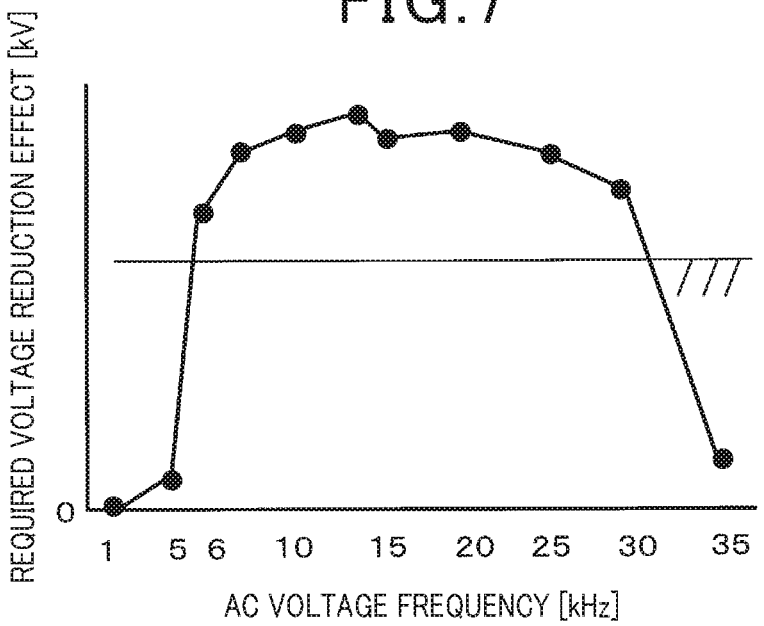
FIG. 7 is a graph showing a result of an evaluation test 1 according to the first embodiment.

Next, an evaluation test 1 was performed for evaluating a relationship between a frequency of the first AC voltage AC1 in the first period and a reduction effect of the required voltage in the major discharge. The test conditions of the evaluation test 1 is as follows. The above-described ignition apparatus 1 was mounted on a 2 litter four cycle engine with a supercharger, under a condition of the ignition apparatus 1 in which the gap distance of the discharge gap G is 1.1 mm, and an amplitude of the first AC voltage AC1 is 7 kv, that is, ±3.5 kv. The engine was rotated under a condition in which the engine rotation speed was set as 1550 rpm, air/fuel ratio of the air-fuel mixture was set as stoichiometric mode, the first period T1 was set with a crank angle ranging from −360 to −160 degrees. Then, a difference was calculated between a required voltage when the AC voltage was applied and a required voltage when the AC voltage was applied. As shown in FIG. 7, higher reduction effect of the required voltage was confirmed when the AC a frequency range of the first AC voltage AC1 in the first period T1 was 6 KHz to 30 KHz. Further, when the resonance frequency of the LC circuit that constitutes the ignition apparatus 1 is around 14 KHz, higher reduction effect of the required voltage was confirmed.

Figure 8:
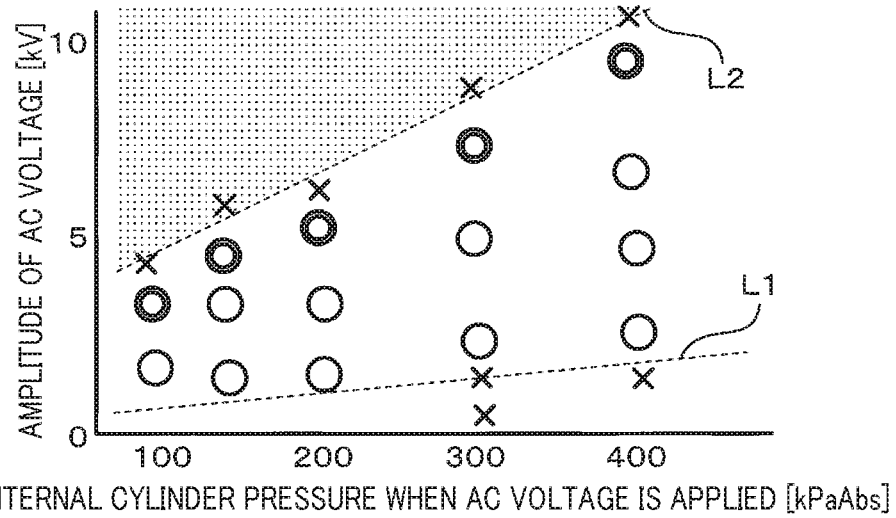
FIG. 8 is a graph showing a result of an evaluation test 2 according to the first embodiment.

Next, a second evaluation test 2 was performed in which a relationship between an internal cylinder pressure in the first period T1, an amplitude W1 of the first AC voltage AC1 in the first period T1, and a reduction effect of the required voltage during the major discharge. The test condition was similar to the evaluation test 1, and a difference was calculated between a required voltage when the AC voltage was applied and a required voltage when the AC voltage was applied. As shown in FIG. 8, it was confirmed that occurrence of spark discharge was suppressed during the first period T1 and sufficient reduction effect of the required voltage was obtained, in a region defined between the first linear line L1 and the second linear line L2, where vertical axis is defined as the amplitude W1 of the AC voltage and the horizontal axis is defined as an internal cylinder pressure during the first period T1.

Figure 9:
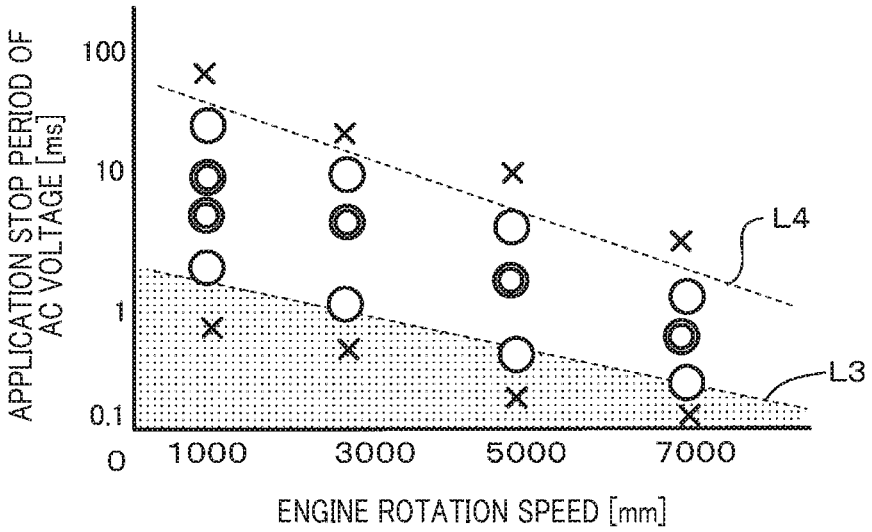
FIG. 9 is a graph showing a result of an evaluation test 3 according to the first embodiment.

Next, an evaluation test 3 was performed for evaluating a relationship between the engine rotation speed in the first period T1, a duration of the second period T2 (i.e., stop period for applying AC voltage), and a reduction effect of the required voltage in the major discharge. The test condition was similar to that of the evaluation test 1 except that the engine rotation speed was set to 1000 rpm, and the difference was calculated between a required voltage when the AC voltage was applied and a required voltage when the AC voltage was applied. As shown in FIG. 9, it was confirmed that occurrence of spark discharge before the major discharge was suppressed and sufficient reduction effect of the required voltage was obtained, in a region defined between the third linear line L3 and the fourth liner line L4.

Next, a control mode of the ignition apparatus 1 according to the present embodiment will be described with reference to FIG. 10. First, at step S1 shown in FIG. 10, the ECU 60 detects a throttle opening of the internal combustion engine and engine load, and the rotation speed detection unit 9 detects the engine rotation speed. Next, at step S2 shown in FIG. 10, the ECU 60 as the internal cylinder pressure estimation unit 7 calculates, based on the detected value at S1, an estimated internal cylinder pressure of a cylinder of the internal combustion engine.

Figure 10:
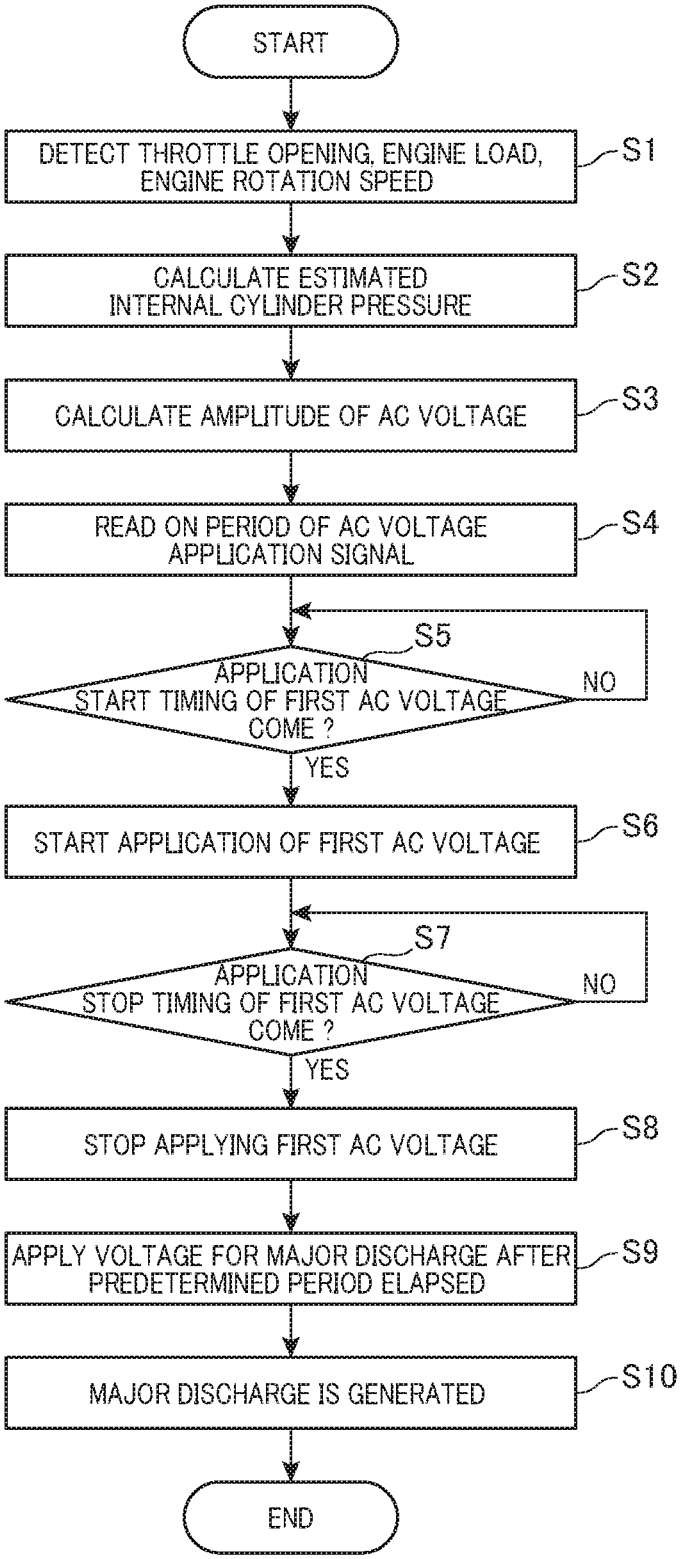
FIG. 10 is a flowchart showing a control state according to the first embodiment.

Thereafter, at step S3 shown in FIG. 10, the process calculates the amplitude W1 of the AC voltage AC1 applied to the ignition plug during the first period T1 by the ECU 60 as the application voltage control unit 6. According to the present embodiment, the application voltage control unit 6 controls the amplitude W1 of the first AC voltage AC1 to be lower than a predetermined reference amplitude when the estimated internal cylinder pressure estimated by the internal cylinder pressure estimation unit 7 is lower than a predetermined reference value, and controls the amplitude W1 of the first AC voltage AC1 to be higher than the predetermined reference amplitude when the estimated internal cylinder pressure is higher than the predetermined reference value. The internal cylinder pressure used for comparing with the estimated internal cylinder pressure may be appropriately set. According to the present embodiment, the predetermined reference value is set to be atmospheric pressure. Further, the above-described predetermined reference amplitude can be set within a range which is lower than the required voltage Vr.

Then, at step S4 shown in FIG. 10, the process reads ON period of the application signal P1 from the map shown in FIG. 11, based on the amplitude W1 calculated in accordance with the output voltage of the power source 55 detected by the power source voltage detection unit 8 and the amplitude W1 calculated at step S3.

At step S5 shown in FIG. 10, the process determines whether an application start timing of the first AC voltage AC1 comes. According to the present embodiment, the start timing of the intake stroke is set to be the application start timing of the AC voltage AC1. When the process determines that the application start timing of the first AC voltage AC1 has not come, the determination at step S5 is NO and the process of the step S5 is executed again. When the process determines that the application start timing of the first AC voltage AC1 has arrived, the determination at step S5 is YES and the application process of the first AC voltage AC1 starts at step S6 shown in FIG. 6 to start the first period T1.

Next, the process determines whether the application stop timing of the AC voltage come or not. According to the present embodiment, the process determines a time when the crank reaches a predetermined crank angle in the compression stroke to be an application stop timing of the first AC voltage. When the process determines that the application stop timing of the first AC voltage has not come, the determination at step S7 is No and executes the process of step S7 again. When the process determines that the application stop timing of the first AC voltage has arrived, the determination at step S7 is Yes, and the process stops applying the first AC voltage AC1 at step S8 shown in FIG. 10 and terminates the first period T1. Thus, the process starts the second period T2. Then, at step S9 shown in FIG. 10, after a predetermined period has elapsed, the process outputs an ignition signal PO shown in FIG. 3A to apply voltage for major discharge. Then, at step S10 shown in FIG. 10, major discharge is generated in the discharge gap G. Thus, the second period T2 is terminated. According to the present embodiment, the second period T2 is set to be a period where gaseous molecules which have been ionized or activated in the pocket 11 and the discharge gap G reach the discharge gap G, or a period where ultraviolet light, emitted when the activated gaseous molecules return to the ground level, reaches the discharge gap G.

Next, effects and advantages of the ignition apparatus 1 of the internal combustion engine 1 according to the present embodiment will be described in more detail. According to the ignition apparatus 1 of the ignition apparatus 1, during the first period T1 before the ignition timing T0, the first AC voltage AC1 having an amplitude W1 which is smaller than that of the required voltage can be applied to the center electrode 400. Thus, an AC electric field is produced in the pocket 11 and the discharge gap G of the ignition plug 2, whereby gaseous molecules in the pocket 11 and the discharge gap G can be ionized or activated. Then, during the second period T2 after the first period T1 has elapsed and before the ignition timing T0, the process stops applying the AC voltage AC1 to the center electrode 400. Thus, gaseous molecules which have been generated in the pocket 11 and the discharge gap G, which are ionized or activated, can be diffused and emitted from the pocket 11 and the discharge gap G. Then, a part of the gaseous molecules which have been ionized or activated reach the discharge gap G, or ultraviolet light, emitted when a part of the activated gaseous molecules returns to the ground level, reaches the discharge gap G when the ignition plug is ignited. Thus, initial electron supply at the discharge gap is accelerated to lower the required voltage Vr. Hence, occurrence of major discharge in the discharge gap G can be accelerated. As a result, discharge can be reliably formed in the gap portion and deep flying-discharge can be avoided. Accordingly, ignitability can be enhanced. Further, since the application of the AC voltage is stopped during the second period T2 immediately before the ignition, a flashover or a corona discharge can be avoided before the major discharge occurs. Moreover, since a high voltage-high frequency signal is not necessarily applied to the ignition apparatus, the apparatus can be prevented from becoming larger, and the manufacturing cost thereof can be suppressed.

According to the present embodiment, the first period T1 is included in a period from a start of the intake stroke to an end of the compression stroke in the internal combustion engine. Thus, since the internal cylinder pressure is maintained or increased during the first period T1, gaseous molecules A2 generated in the pocket 11 and the discharge gap G which have been ionized or activated are likely to be accumulated in the pocket 11 and the discharge gap G. As a result, during the second period T2, gaseous molecules A2 accumulated in the pocket 11 and the discharge gap G which have been ionized or activated are discharged together, whereby the gaseous molecules A2 which have been ionized or activated can readily reach the discharge gap G.

Also, according to the present embodiment, the first period T1 is defined as a period extending from the intake stroke to the compression stroke in the internal combustion engine. Thus, since a sufficiently long period can be secured for the first period T1, gaseous molecules A1 in the pocket 11 and the discharge gap G can be ionized or activated, whereby discharge formation can be reliably secured and the ignitability can be further improved.

Further, according to the present embodiment, the first period T1 starts simultaneously with the intake stroke of the internal combustion engine and continues to the middle of the compression stroke. Thus, since the first AC voltage is applied to the ignition plug during an initial stage of the intake stroke in which the internal cylinder pressure is low, gaseous molecules A1 in the pocket 11 and the discharge gap G can readily be ionized or activated and the first period T1 can be relatively longer. Accordingly, gaseous molecules A1 in the pocket 11 and the discharge gap G can be sufficiently ionized or activated, whereby reliable discharge formation can be secured and ignitability can be further improved.

Also, according to the present embodiment, the internal cylinder pressure estimation unit 7 which estimates the internal cylinder pressure of the internal combustion engine is provided. The application voltage control unit 6 is configured such that the amplitude W1 of the first AC voltage is capable of being changed based on the estimated internal cylinder pressure estimated by the internal cylinder pressure estimation unit 7. According to the present embodiment, the application voltage control unit 6 is configured such that the amplitude W1 of the first AC voltage AC1 is set to be smaller than a predetermined reference amplitude when the estimated internal cylinder pressure estimated by the internal cylinder pressure estimation unit 7 is lower than a predetermined reference value, and the amplitude W1 of the first AC voltage AC1 is set to be larger than the predetermined reference amplitude when the estimated internal cylinder pressure estimated by the internal cylinder pressure estimation unit 7 is higher than a predetermined reference value. Thus, when the internal cylinder pressure is low, the amplitude W1 is set to be small so as to lower the power consumption. Also, when the internal cylinder pressure is high, the amplitude W1 is set to be large so that gaseous molecules A1 in the pocket 11 and the discharge gap G are more effectively ionized or activated. As a result, the power consumption can be reduced and also the ignitability can be improved by reducing the required voltage Vr.

Further, according to the present embodiment, the power source voltage detection unit 8 is provided. The power source voltage detection unit 8 detects the output voltage of the power source 55 for supplying power to the AC voltage application unit 5. The application voltage control unit 6 is configured such that the ON period R of the application signal P1 used for applying the first AC voltage AC1 is capable of being adjusted based on the output voltage detected by the power source voltage detection unit 8. Thus, since the ON period R of the application signal P1 can be set depending on the output voltage of the power source 55, the amplitude W1 of the first AC voltage AC1 can be set to be a predetermined value.

Also, according to the present embodiment, the application voltage control unit 6 is configured to set the duration of the second period T2 to be a period where the gaseous molecules A2 which have been ionized or activated in the pocket 11 and the discharge gap G reach the discharge gap G, or a period where ultraviolet light, emitted when a part of the activated gaseous molecules A2 return to the ground level, reaches the discharge gap G. Thus, the gaseous molecules A2 which have been ionized or activated reach the discharge gap G, or ultraviolet emitted when a part of the activated gaseous molecules A2 return to the ground level reach the discharge gap G, thereby producing the major discharge. Hence, the required voltage is lowered and the ignitability can be improved.

According to the present embodiment, the rotation speed detection unit 9 that detects the engine rotation speed of the internal combustion engine is provided. The application voltage control unit 6 is configured to set the duration of the second period T2 is set to be longer than a predetermined reference period when the engine rotation speed detected by the rotation speed detection unit 9 is higher than a predetermined reference value, and to set the duration of the second period T2 to be shorter than the predetermined reference period when the engine rotation speed detected by the rotation speed detection unit 9 is lower than a predetermined reference value. Thus, the duration of the second period T2 can be adjusted to have optimized length such that the gaseous molecules A2 which have been ionized or activated, or ultraviolet light, emitted when a part of the activated gaseous molecules A2 return to the ground level, reliably reaches the discharge gap in the ignition timing. As a result, the required voltage Vr is lowered so that the ignitability can be improved.

According to the present embodiment, the application voltage control unit 6 is configured to set a duration t2 of the second period T2 to satisfy a relationship $d1/v2<T2<d/v1+d2/v2$ where the shortest linear distance between the pocket 11 and the discharge gap G is d1, the longest linear distance between the pocket 11 and the discharge gap G is d2, a depth in the axial direction X of the pocket 11 is d, a diffusion speed in the pocket 11 is v1, and a flow rate at the discharge gap G in the pocket 11 is v2. Thus, since the major discharge is produced after the gaseous molecules which have been ionized reach the discharge gap G, the required voltage is lowered and the ignitability can be improved.

As described above, according to the present embodiment, the ignition apparatus 1 of the internal combustion can be provided in which an ignitability is improved and an increase in size and high cost are avoided.

Second Embodiment

Figure 12:
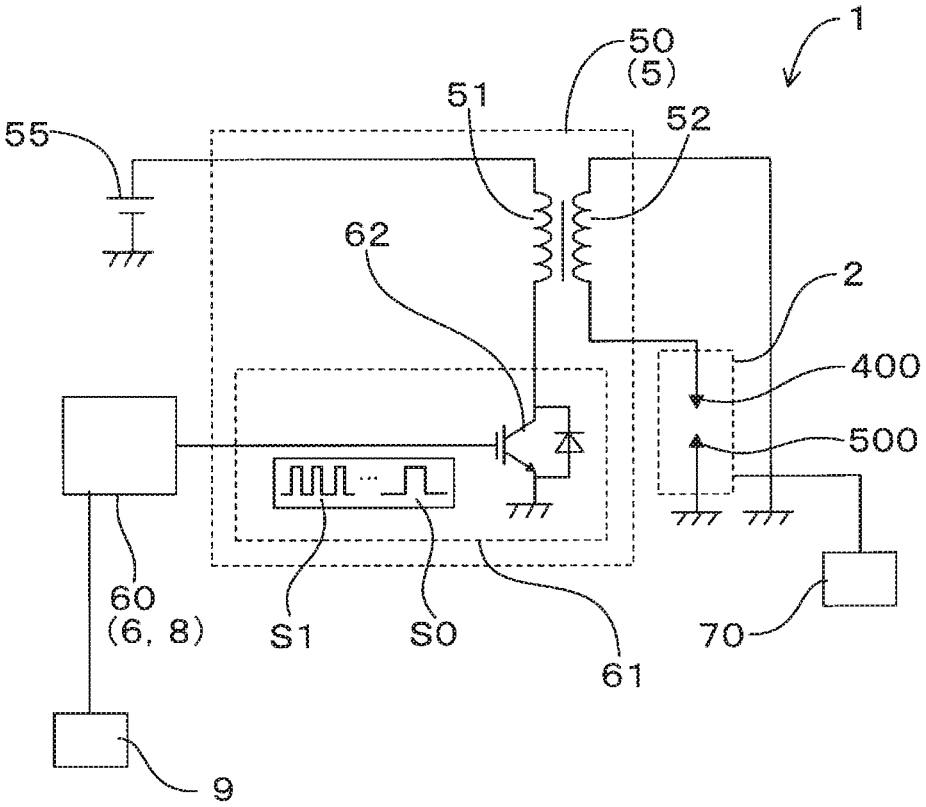
FIG. 12 is a schematic diagram showing a circuit confirmation of an ignition apparatus according to a second embodiment.

The ignition apparatus 1 of the internal combustion engine according to the present embodiment is provided with an internal cylinder pressure detection unit 70 as shown in FIG. 12 instead of the internal cylinder pressure estimation unit 7 of the first embodiment shown in FIG. 1. Other elements are the same as those of the first embodiment. Hence, according to the present embodiment, the same reference numbers as the first embodiment are used and the explanation thereof will be omitted.

According to the present embodiment, the internal cylinder pressure detection unit 70 is configured to detect the internal cylinder pressure of the internal combustion engine. The application voltage control unit 6 is configured to change the amplitude W1 of the first AC voltage AC1 based on the internal cylinder pressure detected by the internal cylinder pressure detection unit 70.

Figure 13:
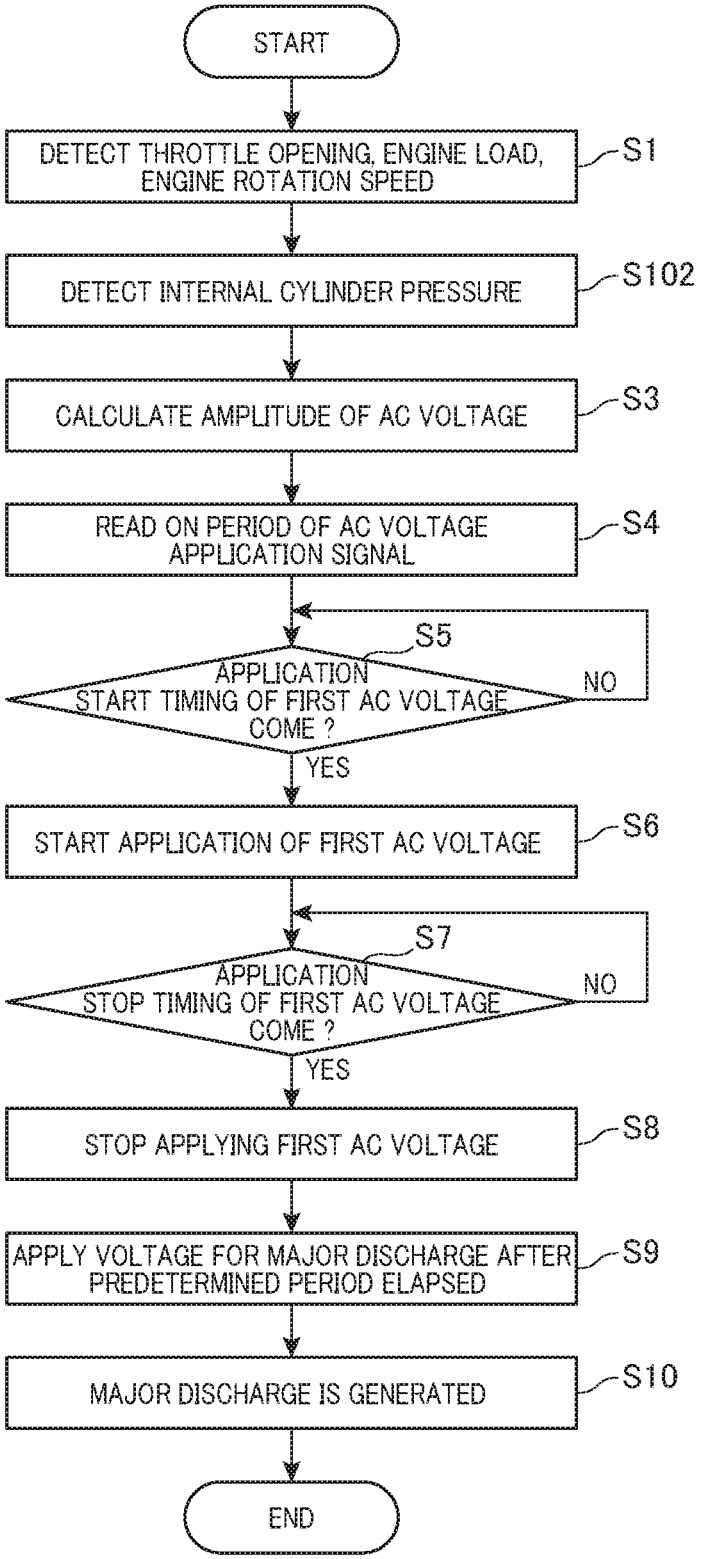
FIG. 13 is a flowchart showing a control state according to the second embodiment.

According to the present embodiment, instead of step S2 in the control flow of the first embodiment 1 shown in FIG. 10, as a step S102 shown in FIG. 13, the internal cylinder pressure detection unit 70 detects the internal cylinder pressure. Thereafter, at step S3 shown in FIG. 13, the application voltage control unit 6 calculates the amplitude W1 of the first AC voltage AC1 applied in the first period T1, based on the internal cylinder pressure detected by the internal cylinder pressure detection unit 70. Other controls are the same as those of the first embodiment.

According to the present embodiment having the above-described configurations, the amplitude W1 is set to be low when the actual internal cylinder pressure is low so that the power consumption is reduced. Further, when the actual internal cylinder pressure is high, the amplitude W1 is set to be high so that gaseous molecules A1 in the pocket 11 and the discharge gap G are more effectively ionized or activated. As a result, the power consumption can be reduced and also the ignitability can be improved by reducing the required voltage Vr. Also, in the present embodiment, similar effects and advantages to the first embodiment can be obtained.

The present invention is not limited to the above-described embodiments. However, the present invention can be applied to various embodiments without departing from the scope of the invention.

What is claimed is:

1. An ignition apparatus of an internal combustion engine comprising:

an ignition plug including:

an insulator having a cylindrical shape, a center electrode having a rod-shape, being supported in the insulator to be coaxial therewith, in which a tip end of the center electrode is exposed therefrom, a housing that supports the insulator, a ground electrode connected to the housing, forming a discharge gap between the tip end of the center electrode and the ground electrode, and a pocket constituted of a space formed between an outer periphery surface of a tip end of the insulator and an inner periphery surface of the housing, in which a portion in a tip end side of the pocket is opened;

an AC (alternating current) voltage application unit configured to apply AC voltage to the center electrode; and an application voltage control unit that controls an operation of the AC voltage application unit, wherein the application voltage control unit is configured to control the AC voltage application unit to apply the center electrode with a first AC voltage having an amplitude which is smaller than that of a required voltage of the ignition plug in a first period which is before an ignition timing, and to apply the center electrode with a second AC voltage having an amplitude smaller than that of the first AC voltage or to stop applying the center electrode with the AC voltage during a second period which is before the ignition timing after the first period has elapsed.

2. The ignition apparatus according to claim 1, wherein the first period is included in a period from a start of an intake stroke to an end of a compression stroke.

3. The ignition apparatus according to claim 1, wherein the first period is defined as a period extending from an intake stroke to a compression stroke in the internal combustion engine.

4. The ignition apparatus according to claim 1, wherein the apparatus includes an internal cylinder pressure estimation unit that estimates internal cylinder pressure of the internal combustion engine; and the application voltage control unit is configured to control an amplitude of the first AC voltage to be lower than a predetermined reference amplitude when an estimated internal cylinder pressure estimated by the internal cylinder pressure estimation unit is lower than a predetermined reference value, and to control the amplitude of the first AC voltage to be higher than the predetermined reference amplitude when the estimated internal cylinder pressure is higher than the predetermined reference value.

5. The ignition apparatus according to claim 1, wherein the apparatus includes an internal cylinder pressure detection unit configured to detect internal cylinder pressure of the internal combustion engine; and the application voltage control unit is configured to control an amplitude of the first AC voltage to be lower than a predetermined reference amplitude when a detected internal cylinder pressure detected by the internal cylinder pressure detection unit is lower than a predetermined reference value, and to control the amplitude of the first AC voltage to be higher than the predetermined reference amplitude when the detected internal cylinder pressure is higher than the predetermined reference value.

6. The ignition apparatus according to claim 1, wherein the apparatus includes a rotation speed detection unit that detects an engine rotation speed of the internal combustion engine; and the application voltage control unit is configured to set a duration of the second period to be longer than a predetermined reference period when the engine rotation speed detected by the rotation speed detection unit is higher than a predetermined reference value, and to set the duration of the second period to be shorter than the predetermined reference period when the engine rotation speed is lower than the predetermined reference value.

7. The ignition apparatus according to claim 1, wherein the apparatus includes a power source voltage detection unit that detects an output voltage of a power source that supplies power to the AC voltage application unit; and the application voltage control unit is configured such that an ON period of an application signal used for applying the first AC voltage is capable of being adjusted based on the output voltage detected by the power source voltage detection unit.

8. The ignition apparatus according to claim 1, wherein the application voltage control unit is configured to set a duration of the second period to be a period where ionized gaseous molecules which are generated in the pocket reach the discharge gap.

9. The ignition apparatus according to claim 1, wherein the application voltage control unit is configured to set a duration t2 of the second period to satisfy a relationship $d1/v2<T2<d/v1+d2/v2$, where the shortest linear distance between the pocket and the discharge gap is d1, the longest linear distance between the pocket and the discharge gap is d2, a depth in an axial direction of the pocket is d, a diffusion speed in the pocket is v1, and a flow rate at the discharge gap in the pocket is v2.

* * * * *